United States Patent [19]

Reick et al.

[11] 4,195,591

[45] Apr. 1, 1980

[54] CASCADE ASSEMBLY AND METHOD

[75] Inventors: Kenneth R. Reick, Oak Brook; William M. Blumthal, Naperville; Harold S. Hurwitz, Downers Grove, all of Ill.

[73] Assignee: Yorktown Industries, Inc., Addison, Ill.

[21] Appl. No.: 865,889

[22] Filed: Dec. 30, 1977

[51] Int. Cl.[2] ..... G03G 13/08

[52] U.S. Cl. ..... 118/655; 430/121

[58] Field of Search ..... 118/644, 647, 648, 649, 118/650, 651, 653, 654, 655, 656, 657, 658; 427/20; 355/3 DD

[56] References Cited

U.S. PATENT DOCUMENTS

| | | | |
|---|---|---|---|
| 3,079,483 | 2/1963 | Codichini et al. | 118/653 X |
| 3,336,905 | 8/1967 | Lehmann | 118/637 X |
| 3,572,289 | 3/1971 | Maksymiak | 118/658 |
| 3,611,992 | 10/1971 | Lyles | 427/20 X |
| 3,638,611 | 2/1972 | Weiler et al. | 118/648 |
| 3,670,701 | 6/1972 | Weiler | 118/654 |
| 3,795,222 | 3/1974 | Jugle et al. | 118/648 |
| 3,799,113 | 3/1974 | Whited | 118/650 |
| 3,863,603 | 2/1975 | Buckley et al. | 118/658 |
| 3,941,470 | 3/1976 | Shah | 355/3 DD |
| 4,095,883 | 6/1978 | Parker et al. | 118/657 |

OTHER PUBLICATIONS

IBM Technical Disclosure Bulletin, vol. 15, No. 3, Aug. 1972, p. 756; Cross Mixer for Developer, K. C. Chaudhary and J. J. Moll.

*Primary Examiner*—Mervin Stein

*Attorney, Agent, or Firm*—Hill, Van Santen, Steadman, Chiara & Simpson

[57] ABSTRACT

Substantially uniform distribution of developer in a cascade assembly for xerographic reproduction apparatus is effected as the developer slides down an inclined cascade baffle onto which the developer is dumped by a succession of buckets which elevate the developer from a sump in the cascade chamber. From the cascade baffle the developer is cascaded substantially uniformly onto a perimeter sector of the electrostatic image carrying drum of the associated apparatus. Uniform developer distribution is attained on the cascade baffle by means of an array of distribution projections.

Toner dust is effectively screened from the image-free areas of the image carrying drum. This is accomplished by efficiently blocking access of the dust to the drum by the position of an effective dust baffle between the developer supply and the drum in the area where the unused developer drops into the developer sump after the developing cascade.

17 Claims, 3 Drawing Figures

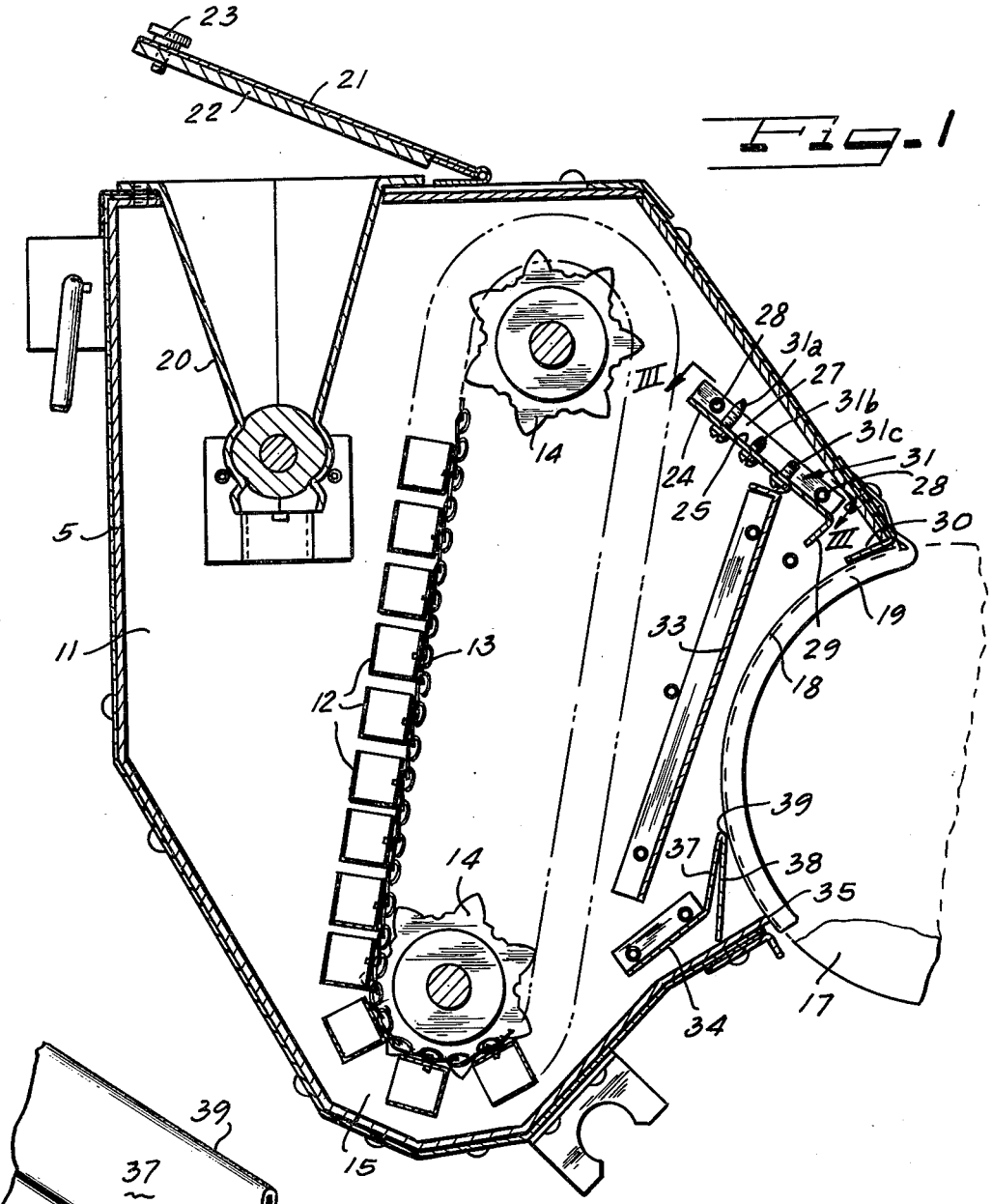
Fig. 1
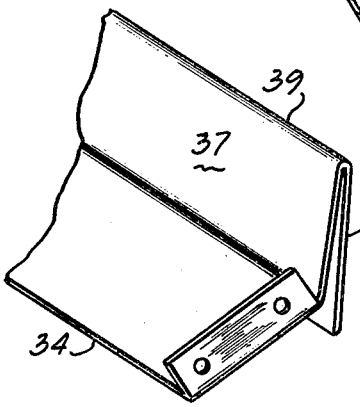
Fig. 2
Fig. 3
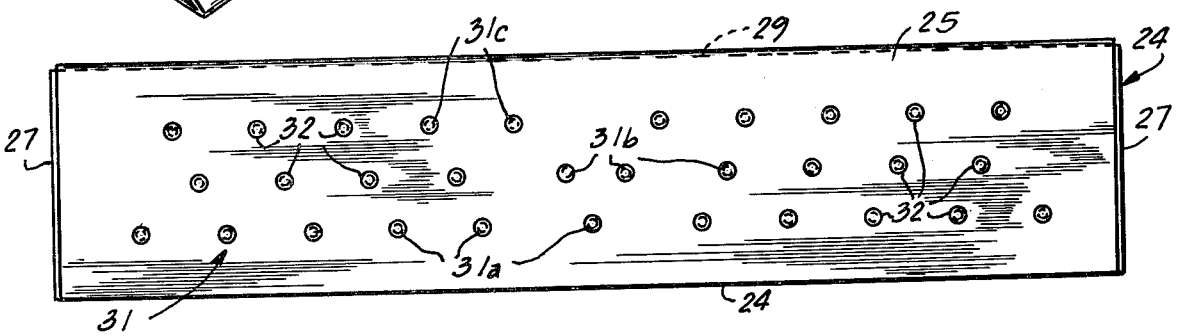

CASCADE ASSEMBLY AND METHOD

The present invention is concerned with improvements in the art of xerography and more particularly relates to a new and improved cascade assembly and method.

In xerography it is common practice to effect transfer of fusible toner powder from cascading developer to the electrostatically charged image on a rotary drum which, in turn, transfers the developed image to a carrier such as a paper sheet onto which the image is then fused. In the cascade developer applicator, the developer comprising toner powder carried electrostatically on particulate transfer medium is scooped by succession of buckets on an endless conveyor from a sump area to an elevated position where the buckets dump the developer which spills toward the perimeter sector of the rotary drum which projects into a window into the cascade chamber and carries on electrostatically charged image. Heretofore there has been a problem in attaining uniform application of the toner to the image area of the drum, especially where for some reason the developer may not cascade uniformly on the image carrying drum perimeter or there may be a diminishing supply of toner compared to the continuously recycled carrier, or because of some other condition in the operation of the toner applicator there may be lack of uniformity in the proportion of toner to transfer medium in at least part of the developer supply scooped by the applicator buckets. As a result uneven toner transfer causes an uneven image intensity in the reproduced image on the carrier sheet.

As the spent developer drops back toward the developer sump, toner powder released from the transfer medium causes a dust cloud in the lower part of the cascade chamber. A problem heretofore encountered has been that some of the powder cloud has settled on the non-image areas of the drum and has been transfered to the image carrier sheet resulting in a gray or clouded background after fusing.

It is accordingly an important object of the present invention to improve the cascade application of developer in xerographic reproduction apparatus and overcome the disadvantages, drawbacks, inefficiencies, shortcomings and problems that have been inherent in prior xerographic apparatus or copiers.

Another object of the invention is to provide new and improved means for and method of effecting substantially uniform distribution of cascaded developer on the image carrying drum of xerographic apparatus.

A further object of the invention is to provide a new and improved means for and method of substantially eliminating dust transfer to the non-image carrying areas of a xerographic drum.

According to features of the invention there is provided a cascade assembly for xerographic apparatus, comprising a housing providing a cascade chamber having therein an endless series of buckets and means for driving the buckets to scoop developer comprising fusible powdered toner carried electrostatically on particulate transfer medium from a sump area to an elevated position where the buckets spill the developer generally toward a perimeter sector of a horizontal axis rotary drum carrying an electrostatic image charge and projecting through a window into the chamber, a cascade baffle tilted toward said drum for guiding the developer spilled from the buckets toward and onto the top of said perimeter sector to cascade thereon and effect transfer of said toner from said transfer medium to said image, and distribution means on said baffle for effecting substantially uniform distribution of the developer as the developer moves down the baffle toward said perimeter section so as to attain substantially uniform cascading of the developer from the baffle onto said perimeter sector and thereby substantially uniform cascading of the developer along said perimeter sector and substantially uniform transfer of toner to said image charge from said transfer medium in the cascading developer.

According to additional features of the invention there is provided a new and improved method of attaining uniform cascading of developer onto the image carrying area of an image transfer drum in xerographic apparatus, adapted to be practiced with the foregoing apparatus.

In accordance with additional features of the invention, there is provided a cascade assembly for xerographic apparatus having a housing providing a cascade chamber in which means are operative for transporting developer comprising fusible powdered toner carried electrostatically on particulate transfer medium from a sump area to an elevated position where the developer is dropped toward a perimeter sector of a rotary drum carrying an electrostatically charged image and projecting through a window into the chamber, a baffle for returning spent cascading developer from the vicinity of said drum perimeter sector to said sump area, and means cooperating with the baffle to screen loose toner powder in the vicinity of said sump area substantially against reaching the drum perimeter whereby to avoid dust contamination of uncharged areas of the drum perimeter.

It is also a feature of the invention to provide a new and improved method of screening the rotary transfer drum perimeter against contamination from toner dust which may occur in the sump area of the cascade chamber within the cascade assembly of xerographic apparatus.

Other objects, features and advantages of the invention will be readily apparent from the following description of a certain representative embodiment thereof, taken in conjunction with the accompanying drawing although variations and modifications may be effected without departing from the spirit and scope of the novel concepts embodied in the disclosure and in which:

FIG. 1 is a vertical sectional detail view through a cascade assembly for xerographic apparatus and embodying features of the invention.

FIG. 2 is a fragmentary isometric view of the spent developer return baffle and dust screen; and FIG. 3 is a top plan view of the cascade baffle and distribution means.

By way of illustrating embodiment of the present invention in a cascade assembly for xerographic apparatus, a housing 5 provides a cascade chamber 11 having therein an endless series of buckets 12 and means comprising an endless conveyor device 13 and sprockets 14 one of which is powered to motivate the conveyor 13 to effect cyclical movement of the buckets 12 to scoop developer from a sump area 15 and carry the developer to an elevated position in the chamber 11 where the buckets spill the developer toward a perimeter sector of a rotary drum 17 carrying an electrostatically charged image and projecting through a window 18 having thereabout appropriate drum sealing means 19. It will be understood, of course, that operation of the developer transporting means comprising the buckets 12 will be operated in suitable synchronism with the rotary drum 17. The drum 17 is adapted to be electrostatically charged with an image on its periphery which attracts fusible powdered toner from transfer medium such as small steel shot or pellets as the developer cascades over the perimeter sector exposed to the cascade through the window 18. Then the toner loaded image is transferred from the drum 17 to a carrier such as a paper sheet, and the thus transferred image is fused onto the sheet. This process of xerographic copying is well known. From time to time or at regular intervals the developer in the sump 15 is recharged with toner from a toner hopper 20 which is adapted to be filled through the top of the housing 5 and closed as by means of a hinged door 21 carrying a sealing gasket 22 and adapted to be secured in closed position over the hopper 20 as by means of a screw 23.

Developer spilled from the buckets 12 is guided toward and onto the top of the perimeter sector of the drum within the chamber 11 by means of a cascade baffle 24 tilted toward the drum 17 and more particularly toward and onto the top of the perimeter sector of the drum within the window 18 to cascade on the perimeter sector and effect transfer of the toner from the transfer medium to the electrostatic image on the drum. In a preferred construction, the baffle 24 comprises a sheet metal plate, although the baffle may be constructed from other material, it may be a casting or molding, and the like. A principal requirement for the baffle 24 is that it comprises a generally upwardly facing developer guiding surface 25 extending obliquely from an upper edge adjacent to the run of the buckets 12 where they spill the developer toward the drum 17, to a cascade drop off at its lower edge adjacently above the top of the underlying perimeter sector of the drum 17 and from which lower edge the developer is permitted to cascade onto the drum. At its opposite ends, the baffle 24 has respective mounting flanges 27 by which the baffle is adapted to be secured as by means of screws 28 to opposite side walls of the housing 5. At its lower, drop off edge the baffle 24 has a generally underturned reinforcing and guide flange 29. Escape of developer from the chamber 11 over the top of the window 18 is prevented by a generally inwardly and downwardly directed deflector flange 30 from which the baffle flange 29 is suitable spaced and with which the baffle flange 29 cooperates for guiding the developer to cascade onto the perimeter of the drum 17 and efficiently cascade down along the perimeter of the drum 17 for transfer of the fusible powdered toner to the electrostatic image on the drum.

For effecting substantially uniform distribution of the developer as the developer moves down the baffle 24 toward the perimeter sector of the drum, distribution means are provided on the surface 25. In a desirable arrangement, the distribution means comprise an array of projections 31. In a preferred arrangement, the projections 31 are located in a plurality of staggered rows extending throughout most of the length and throughout a large proportion of the width of the baffle 24. Experimentation with various arrangements of the projections 31 has revealed that three spaced rows of the projections 31 lengthwise of the baffle 24 and with the projections in each of the rows staggered with respect to each of the other rows, substantially as shown, provides excellent developer distribution results. In this arrangement a top row of projections 31*a* contains eleven projections wherein there are five of the projections 31*a* at each side of a center projection. An intermediate row of the projections identified as 31*b* comprises ten of the projections with the two projections 31*b* at the center spaced equally in staggered relation to opposite sides of the center projection 31*a* and the remaining projections 31*b* offset or staggered in substantially the same manner relative to corresponding ones of the upper row of projections 31*a*. In the third, bottom row of projections 31*c*, ten of the projections 31*c* are staggered in offset relation toward the opposite ends of the baffle 24 relative to the projections 31*b* and in staggered offset relation to all of the upper row of projections 31*a*. In the arrangement shown, the three rows of projections are in substantially equally spaced relation. Alignment of the projections in the rows is such that they line up in diagonal three-projection rows along the width of the baffle 24. It has also been found advantageous to have the upper row of projections 31*a* about twice as high as the two lower rows of projections 31*b* and 31*c*. For example, where the projections are about 0.111 inch in diameter, the projections 31*a* may be about ⅜ inch in length and the projections 31*b* and 31*c* about 3/16 inch in length. This substantially assures that the longer projections 31*a* will be effective in initiating the distribution action on the developer as it is spilled onto the upper part of the baffle 24 and then as the developer settles down as it slides on down the baffle the shorter projections 31*b* and 31*c* will be amply effective.

A synergistic effect attributable to the projections 31 has been noted, namely, an improvement in the triboelectric charge carried by the developer which enhances toner transfer to the oppositely charged image on the drum 17. It has also been discovered that substantial additional triboelectric charge improvement is attained by having the perimeters of the projections 31 rough instead of straight or plain. Satisfactory roughness of the projection peripheries is attained by utilizing self-threading screws of suitable length secured in appropriately drilled or punched holes 32 in the baffle 24 through which the projection screws are driven so that the screw shanks project from the baffle surface 25. The improved results from the screw threaded peripheries of the projections 31 in attaining triboelectric charge effectiveness may be attributable to the greater turbulence or churning occuring as the developer impinges on and is repeatedly spread and respread on contacting the rough perimeters of the projections 31. A further desirable benefit derived from the projections 31 on the baffle 24 is that there is no need for a mixing or churning device in the developer sump 15 as has been deemed desirable heretofore to attain adequate intensity of triboelectric charge in the developer and more particularly the ferrous transfer agent or medium. In other words by virtue of the baffle projections 31 superior triboelectric charge is attained supplemental to triboelectric charging that occurs as the spent developer cascades from the perimeter of the drum 17 and returns to the sump which involves substantial turbulence and bouncing contact of the ferrous transfer medium particle to particle and against surfaces in the cascade chamber 11.

Efficiency of cascade contact of the developer with the periphery of the drum 17 is assured by substantial confinement of the cascading developer to the drum periphery by means of a generally downwardly and inwardly extending deflector plate 33. At its upper end the plate 33 is located adjacent to the baffle 24 inwardly from and above the flange 29 so that any developer that may bounce inwardly and upwardly away from the drum perimeter will be deflected toward the drum perimeter. Intermediately, the deflector plate 33 approaches the drum perimeter in fairly closely spaced relation about mid-way of the extent of the peripheral portion of the drum perimeter exposed within the window 18. Such spacing is, of course, ample to avoid any blockage in free cascading of the developer along the drum perimeter but close enough to assure deflection toward the drum perimeter of developer that may tend to stray away from the drum perimeter. Below the closest approach of the deflector plate 33 to the drum perimeter, the plate diverges relative to the drum perimeter to a substantially wider spacing so as to permit spent developer to cascade relatively freely toward the sump 15.

In suitably spaced relation below the lower edge of the deflector plate 33 is located a developer return baffle 34 which is secured at its opposite ends to the housing side walls defining the chamber 11. This baffle 34 slopes downwardly and inwardly away from the drum perimeter, and diverts toward the sump 15 spent developer which cascades from the drum. To prevent the spent cascading developer from travelling to a gate 35 located at the lower side of the window 18, the baffle 34 is provided with a generally upstanding baffle flange 37 slanting toward the drum 17 from its lower end attached to the upper edge of the baffle 34. At its upper edge the flange 37 is sufficiently closely adjacent to the perimeter sector of the rotary drum 17 below where the cascading developer drops from the perimeter sector to substantially avoid escape of developer past the upper edge of the baffle flange 37. Thus, the baffle flange 37 cooperates with the baffle 34 to divert the spent developer efficiently toward the sump 15. Further, as the spent developer drops onto the baffle flange 37 and the baffle 34 the developer, and especially the particulate transfer medium is subjected to substantial triboelectric charging action in which the lower end portion of the deflector 33 cooperates with respect to any transfer medium bouncing thereagainst.

In the turbulent agitation of the spent developer diverted by the baffle 34, a toner dust cloud is experienced in the vicinity of the baffle 34. Eventually the toner dust is recaptured by the triboelectrically charged transfer medium, but some of the clouds may tend to migrate to the uncharged area of the perimeter of the drum 17 and transfer therefrom to the carrier copy sheet to which the developed image is transferred by the drum, so that upon fusion of the image on the copy sheet, the migrated toner is also fused and results in a cloudy or darkened background. According to the present invention such toner dust migration is substantially completely avoided by efficiently screening the dust cloud area from the perimeter of the drum 17. Simple and effective means for this purpose comprise a dust barrier flange 38 which may be formed integral with and extends from a juncture bend 39 along the top edge of the baffle flange 37. The flange 38 is of a width sufficient to locate its lower edge close enough to the underlying wall of the housing 5 inwardly from the gate 35 to provide a closure for blocking migration of the toner dust toward the perimeter of the drum 17. By having the flanges 37 and 38 integral and joined along the bend 39, there is no gap between the joined edges of the flanges through which any dust might escape. By virtue of the upper edges of the flanges 37 and 38 being substantially above the baffle 34 and in particular the spent developer return gap between the baffle 34 and the lower edge of the deflector 33, and thus substantially above the area of dust cloud occurence, a quite effective barrier against migration of toner dust to the perimeter of the drum 17 is provided. It will be understood, of course, that all of the baffle 34, flanges 37 and 38, the deflector 33 as well as the cascade baffle 24 extend fully to and between the side walls of the housing 5 defining the cascade chamber 11.

Copies produced by xerographic apparatus employing the present invention have sharp, uniformly dense fused images free from clouded background.

It will be understood that variations and modifications may be effected without departing from the spirit and scope of the novel concepts of this invention.

We claim as our invention:

1. A cascade assembly for xerographic apparatus, comprising:

a housing providing a cascade chamber having therein an endless series of buckets and means for driving the buckets to scoop developer comprising fusible powdered toner carried electrostatically on particulate transfer medium from a sump area to an elevated position where the buckets spill the developer generally toward a perimeter sector of a horizontal axis rotary drum carrying an electrostatic image charge and projecting through a window into the chamber;

a generally upwardly facing cascade baffle elongated substantially parallel to the drum axis and said baffle having its upper edge adjacent to said elevated position to receive said developer spilled from said buckets and having a lower edge adjacent to but spaced from the top of said perimeter sector of said drum, and adapted for guiding the developer spilled from the buckets toward and onto the top of said perimeter sector to cascade thereon and effect transfer of said toner from said transfer medium to said image charge;

and distribution means comprising upward projections on said upper face of said baffle for effecting substantially uniform distribution of the developer as the developer moves down said baffle upper face toward said perimeter sector so as to attain substantially uniform cascading of the developer from the baffle onto said perimeter sector and thereby substantially uniform cascading of the developer along said perimeter sector and substantially uniform transfer of toner to said image charge from said transfer medium in the cascading developer;

said upward projections comprising a plurality of rows of the projections in which the projections are spaced apart in the rows and the projections in each row are staggered with respect to the projections in an adjacent row.

2. An assembly according to claim 1, wherein said upward projections have rough perimeters.

3. An assembly according to claim 1, wherein said upward projections comprise screw shanks.

4. An assembly according to claim 1, in which one of the rows of projections is located at a higher position on the baffle than another row of the projections at a lower position.

5. An assembly according to claim 4, wherein the projections in said row located at a higher position are longer than the projections in said row located at a lower position.

6. A cascade assembly for xerographic apparatus, comprising:

a housing providing a cascade chamber having therein an endless series of buckets and means for driving the buckets to scoop developer comprising fusible powdered toner carried electrostatically on particulate transfer medium from a sump area to an elevated position where the buckets spill the developer generally toward a perimeter sector of a horizontal axis rotary drum carrying an electrostatic image charge and projecting through a window into the chamber, said window having a lower gate at the drum perimeter on a bottom wall of said chamber;

a cascade baffle tilted toward said drum for guiding the developer spilled from the buckets toward and onto the top of said perimeter sector to cascade thereon and effect transfer of said toner from said transfer medium to said image charge;

distribution means on said baffle for effecting substantially uniform distribution of the developer as the developer moves down the baffle toward said perimeter sector so as to attain substantially uniform cascading of the developer from the baffle onto said perimeter sector and thereby substantially uniform cascading of the developer along said perimeter sector and substantially uniform transfer of toner to said image charge from said transfer medium in the cascading developer;

a deflector extending downwardly from said cascade baffle and adjacent to said perimeter sector of the drum to confine cascading developer to said perimeter sector;

a diverting baffle below said deflector for diverting spent developer cascading from said perimeter sector to said sump area;

and a toner dust barrier at that end of the diverting baffle which is nearest to said perimeter sector, said barrier extending downwardly from said diverting baffle and closing off the space between said diverting baffle and said lower wall from said sump area for preventing migration of toner dust between said diverting baffle and said lower wall to said perimeter sector.

7. An assembly according to claim 6, wherein said diverting baffle comprises a plate, and said dust barrier comprises a downwardly extending flange on said plate.

8. An assembly according to claim 7, wherein said diverting baffle has on its edge which is nearest said perimeter sector a generally upwardly projecting flange extension terminating adjacent to said perimeter sector, and said dust barrier flange comprises a downwardly projecting integral extension from said flange extension and having a lower edge adjacent to said bottom wall of said chamber.

9. A cascade assembly for xerographic apparatus, comprising:

a housing providing a cascade chamber and having a wall provided with a window into the chamber and through which window a perimeter sector of a horizontal axis rotary drum carrying an electrostatic charge image projects;

means within the cascade chamber for effecting a cascade of developer comprising fusible powdered toner carried electrostatically on particulate transfer medium over said perimeter sector;

a baffle within said chamber for agitating and diverting toward a sump in said chamber spent developer cascading from said sector;

said housing having a bottom wall underlying said baffle in spaced relation;

said barrier means carried by said baffle and located between said baffle and said underlying wall and providing a closure extending generally upright across the space between said baffle and said underlying wall and blocking communication between said sump and said sector and preventing toner dust from migrating through said space to uncharged areas on said sector.

10. An assembly according to claim 9, wherein said baffle comprises a plate having a deflector flange along an edge adjacent to said drum, and said barrier means comprise a barrier flange extending from said deflector flange.

11. In a cascade assembly for xerographic apparatus in which a housing provides a cascade chamber having therein means for cascading onto the perimeter of a horizontal axis rotary drum carrying an electrostatic image charge developer comprising fusible powdered toner carried electrostatically on particulate transfer medium:

a cascade device comprising a baffle having an upper face extending obliquely from an upper edge adjacent to said cascading means to a lower edge located in spaced relation above a sector of said perimeter, and receptive adjacent said upper edge of toner from the cascading means for guiding the developer toward and permitting the developer to fall onto the perimeter of the drum at the top of said sector to cascade along said sector and effect transfer of the toner from the transfer medium to the image charge;

and distributor means comprising upward projections arranged in a plurality of rows in which the projections are spaced apart in the rows and the projections in each row are staggered with respect to the projections in an adjacent row on said baffle face for effecting substantially uniform distribution and improved triboelectric charge of the developer in movement along the baffle between said upper edge and said lower edge.

12. A cascade device according to claim 11, wherein said projections comprise screw shanks.

13. A dust barrier device for a cascade assembly for xerographic apparatus wherein a housing provides a cascade chamber having therein means for transporting developer comprising fusible powdered toner carried electrostatically on particulate transfer medium from a sump area to an elevated position and effecting cascading of the developer along the perimeter of a horizontal axis rotary drum carrying an electrostatic image charge, the device comprising:

a bottom wall in said chamber and said wall having a gate at said drum perimeter substantially spaced below and away from the point where spent cascading developer drops away from the drum perimeter;

a generally upright barrier member having means for mounting it in the cascade chamber adjacent to the drum perimeter and below where said spent developer drops away from the drum perimeter and said bottom wall and adapted to serve as means for diverting said spent cascading developer toward said sump area and also to serve as a closure between the portion of the drum perimeter extending from the top of said barrier member to said gate and the dropped spent developer and the sump area and any toner dust cloud that may be present inwardly from said barrier member;

and said barrier member having a depending closure flange extending across the space between said barrier member and said bottom wall to prevent said toner dust from migrating to the perimeter of the drum between the top of said barrier member and said gate.

14. A method of effecting substantially uniform cascading of developer comprising fusible powdered toner carried electrostatically on particulate transfer medium transported from a sump in a cascade chamber and spilled from an upper elevation generally toward a perimeter sector of a horizontal axis rotary drum carrying an electrostatic image charge and projecting through a window into the chamber, comprising:

receiving the spilled developer on a cascade baffle having an upper face tilted toward said drum and having an upper edge adjacent to said elevated position and a lower edge adjacent to but spaced above the top of said perimeter sector and thereby guiding the developer onto the top of said perimeter sector to effect cascading of the developer thereon and effecting transfer of toner from the transfer medium to the image charge;

providing said cascade baffle with a plurality of rows of projections in which the projections are spaced apart in the rows and the projections in each row are staggered with respect to the projections in an adjacent row;

and substantially uniformly distributing the developer on said cascade baffle upper face by impinging said developer against said projections while moving the developer down the baffle toward the perimeter sector and thereby causing substantially uniform cascading of the developer from the lower edge of the cascade baffle onto the perimeter sector of the drum.

15. A method of effecting cascade development of electrostatic image charge on the perimeter of a horizontal axis rotary drum wherein the drum has a sector of its perimeter projecting into a housing providing a cascade chamber having therein means for transporting developer comprising fusible powdered toner carried electrostatically on particulate transfer medium from a sump area to an elevated position and a bottom wall providing a gate at said drum perimeter substantially below and spaced from the point of where spent cascading developer drops away from the drop perimeter, comprising:

cascading from said elevated position the developer comprising fusible powdered toner carried electrostatically on particulate transfer medium onto the drum perimeter and transferring toner to the image charge;

diverting the spent developer on a baffle from adjacent to the point of cascading toner drop off and returning said spent developer to said sump area;

and providing a generally upright dust barrier between said bottom wall and said baffle and thereby substantially completely closing off that portion of the drum perimeter between said drop off point and said gate against migration of toner dust from the vicinity of said sump onto said portion of said drum perimeter.

16. A cascade assembly for xerographic apparatus, comprising:

a housing providing a cascade chamber having therein an endless series of buckets and means for driving the buckets to scoop developer comprising fusible powdered toner carried electrostatically on particulate transfer medium from a sump area to an elevated position where the buckets spill the developer generally toward a perimeter sector of a horizontal axis rotary drum carrying an electrostatic image charge and projecting through a window into the chamber;

a cascade baffle tilted toward said drum for guiding the developer spilled from the buckets toward and onto the top of said perimeter sector to cascade thereon and effect transfer of said toner from said transfer medium to said image charge;

and upward distribution projections comprising screw shanks on said baffle for effecting substantially uniform distribution of the developer as the developer moves down the baffle toward said perimeter sector so as to attain substantially uniform cascading of the developer from the baffle onto said perimeter sector and thereby substantially uniform cascading of the developer along said perimeter sector and substantially uniform transfer of toner to said image charge from said transfer medium in the cascading developer.

17. A method of effecting substantially uniform cascading of developer comprising fusible powdered toner carried electrostatically on particulate transfer medium transported from a sump in a cascade and spilled from an upper elevation generally toward a perimeter sector of a horizontal axis rotary drum carrying an electrostatic image charge and projecting through a window into the chamber, comprising:

receiving the spilled developer on a cascade baffle having an upper face tilted toward said drum and having an upper edge adjacent to said elevated position and a lower edge adjacent to but spaced above the top of said perimeter sector and thereby guiding the developer onto the top of said perimeter sector to effect cascading of the developer thereon and effecting transfer of toner from the transfer medium to the image charge;

equipping said upper face of said cascade baffle with an array of screw shanks and impinging the developer against said screw shanks;

and effecting substantially uniform distribution and triboelectric charging of the developer by said impinging of the developer against said screw shanks while moving the developer down said baffle upper face toward said perimeter sector, and thereby causing substantially uniform cascading of the developer from the lower edge of the cascade baffle onto said perimeter sector of the drum.

* * * * *